US005869131A

United States Patent [19]

Henke et al.

[11] Patent Number: 5,869,131

[45] Date of Patent: Feb. 9, 1999

[54] PROCESS FOR THE SIMULTANEOUS TREATMENT OF THE TOP AND BOTTOM SIDES OF A WEB OF PAPER SUPPORT

[75] Inventors: Frank Henke, Neu Wulmstorf; Karsten Seitz, Buxtehude; Ralf Hirsch; Christian Detzer, both of Hamburg; Herbert Knolle, Reinbek, all of Germany

[73] Assignee: Beiersdorf AG, Hamburg, Germany

[21] Appl. No.: 914,926

[22] Filed: Aug. 20, 1997

[30] Foreign Application Priority Data

Aug. 22, 1996 [DE] Germany ..... 196 33 766.6

[51] Int. Cl.[6] ..... B05D 1/00

[52] U.S. Cl. ..... 427/211; 427/428

[58] Field of Search ..... 427/210, 211, 427/428

[56] References Cited

U.S. PATENT DOCUMENTS

| | | | |
|---|---|---|---|
| 2,416,232 | 2/1947 | Soday | 427/428 |
| 5,378,497 | 1/1995 | Johnson et al. | 427/211 |
| 5,677,008 | 10/1997 | Kameya et al. | 427/428 |

*Primary Examiner*—Bernard Pianalto
*Attorney, Agent, or Firm*—Sprung Kramer Schaefer & Briscoe

[57] ABSTRACT

Process for the simultaneous treatment of the top and bottom sides of a web of paper support each with a liquid coating material, wherein a) the web of paper support is passed through the gap between two rubber rollers rotating in the same direction, b) the top side of the web of paper support is treated with the first coating material by means of a first rubber roller, the first coating material is transferred to the first rubber roller by a first screen roller rotating in the opposite direction, the first coating material is applied to the first screen roller by means of a pouring device, c) the bottom side of the web of paper support is treated with the second coating material by means of a second rubber roller, the second coating material is transferred to the second rubber roller by a second screen roller rotating in the opposite direction, the second coating material is applied to the second screen roller by means of a pouring device.

11 Claims, 1 Drawing Sheet

PROCESS FOR THE SIMULTANEOUS TREATMENT OF THE TOP AND BOTTOM SIDES OF A WEB OF PAPER SUPPORT

The invention relates to a process for the simultaneous treatment of the topside and underside of a web of paper support each with a liquid coating material.

Paper is frequently used as a support material for adhesive tapes. Such tapes are used, inter alia, as masking tapes in painting and decorating, binding tapes for the processing of electronic components or as adhesive tapes in packaging.

Very often the paper supports are for this purpose subjected to a special pretreatment. The paper is initially provided with an impregnation. The impregnation gives the paper additional strength and insensitivity to moisture. Frequently, the impregnating agents are aqueous dispersions, but solvent-based systems are also possible.

Polymers which can be used for impregnation are, for example:

styrene-butadiene copolymers, acrylonitrile-butadiene copolymers, acrylates, polychloroprenes and also polymers from these groups that are modified with carboxyl-containing or other comonomers. Mixtures of the polymers are also possible, as are mixtures with further materials, for example resins, plasticizers and other auxiliaries.

The list in no way claims completeness, but it provides a small selection from the possible polymers. A summarizing description of the impregnation technology is to be found, for example, in the textbook by D. Satas (D. Satas: Handbook of Pressure Sensitive Adhesion Technology, Van Nostrand Reinhold Company Inc., New York, 1982, page 404 et seq.).

In further processing steps, the paper supports are provided with a coating layer on the back, a so-called release coating, and with a primer on the side which later is to be adhesive.

The release coating initially here has the function of limiting the adhesion of the adhesive compound to the back of the paper to a level which, on the one hand, ensures easy removal of a length of tape from the roll. On the other hand, a minimum adhesion must also be maintained, since unduly easy unrolling, for example solely under the action of gravity (the so-called yo-yo effect), is equally undesirable. In addition, the release coating must also satisfy requirements for specific applications, for example adequate adhesion of coatings and inks to the back of the tape in the case of masking tapes for decorating or low-noise unrolling in the case of adhesive tapes for packaging.

Very frequently, aqueous dispersions or mixtures of aqueous dispersions are used as release coatings, but solvent-based systems or so-called 100% systems are also possible.

The choice of suitable polymers as a base for release coatings is very wide, and in addition release systems are frequently formulated as mixtures of different polymers or else low-molecular agents effective for separation, for example waxes, greases or the like. Only a few possibilities are therefore presented here.

Frequently, PVC-based systems, acrylates, acrylate copolymers or vinyl acetate copolymers are used. Often, the systems also consist of mixtures in which one part takes on the function of a binder, while the release effect is based on a further constituent. An example which may be mentioned here is the mixture of an SBR latex (binder) with a copolymer of styrene and maleimide, such as is described in German Offenlegungsschrift DE-A 28 45 541. If appropriate, a third component based on acrylate can also be used in addition.

A survey of the state of the art relating to the release coating is given in the textbook by Satas quoted above (pages 370 et seq.).

The primer has the object of assisting the anchorage of the adhesive compound on the paper support. Without the application of a suitable primer, the adhesive compound is frequently detached on peeling from the substrate, which is not acceptable, inter alia, in the case of masking tapes for painting and decorating.

Very frequently, aqueous dispersions or mixtures of aqueous dispersions are used as primers, but solvent-based systems are also possible.

Suitable systems to be used here as polymer base are all those which are capable of enhancing the affinity of the adhesive compound for the impregnated paper support. For this purpose, systems are frequently used which are chemically similar both to the adhesive compound and to the impregnating agent, that is to say, for example, a system based on natural rubber for adhesives. Alternative systems which may be mentioned are systems based on modified natural rubber, on synthetic rubbers and on blends with other substances contained in the adhesive compounds, for example resins.

Solvent-based primers can, if appropriate, also be provided with reactive components in order to ensure strong bonding to the adhesive compounds. In solvent-based primers, the use of isocyanates for this purpose is not unusual.

The release coatings and primers are applied via rollers, blades and the like. Thus application by means of a blade is carried out by passing the web of paper support below the blade at a presettable distance, the component to be coated being put onto the web of paper support upstream of the blade. The blade ensures uniform application of the component.

Furthermore, the application of the component to be coated can be effected via a roller, if appropriate in combination with a blade.

Finally, as shown in German Offenlegungsschrift DE-A 43 29 218, the component can also be drawn into the web of paper support by means of reduced pressure by using a suction roller over which the web of paper support is passed.

All these application technologies have the common feature that release coating and primer are applied in separate process steps.

However, this type of application involves some disadvantages. The first to be mentioned here is the large spatial extent of such a sequential application unit, in particular if the release coating is first dried before the primer is applied.

In these cases it is extremely difficult, if not altogether impossible, to obtain a perfect flat position or plane position of the paper.

It is a further disadvantage of the process that, with the one-sided application process, a breakthrough of the coating or of the primer occurs again and again. This disadvantage manifests itself particularly seriously when relatively thin paper supports are coated with low viscosity media.

The adverse effects of a breakthrough are obvious:

- breakthrough of the release coating to the primer side reduces the adhesion of the adhesive compound on the latter and can then cause the peeling phenomena of the adhesive compound, as described above.
- breakthrough of the primer to the release side enhances the adhesion of the adhesive compound to the latter; this results in unacceptably high unrolling forces or even punctiform or a real tearing-out of adhesive compound during unrolling.

A further disadvantage of the process is that the quantity of the release coating or primer available on the surface of the paper fluctuates widely, since a part of the media sinks into the support. This proportion varies as a function of the absorption capacity of the paper for the particular medium. The absorbency of the paper is, however, by no means constant, either from batch to batch or within one batch. Furthermore, pores or pinholes which further reinforce breakthrough cannot be excluded in the case of crepe papers.

Correspondingly large application quantities must be selected, in order to compensate even pronounced losses into the paper. At the same time, however, this increases the risk of a breakthrough of the composition.

It was the object of the invention to provide a process which does not have the disadvantages of the state of the art, or at least not to this extent, and which, in particular, prevents the breakthrough of the particular coating material.

This object is achieved by a process such as is described in Claim 1. Claim 2 describes a second embodiment of the process, which differs from the former only in that one rubber roller has been omitted, that is to say the application is effected directly by means of a screen roller rotating in the opposite direction. The subclaims which follow represent advantageous further developments.

Accordingly, the process for the simultaneous treatment of the top and bottom sides of a web of paper support each with a low-viscosity coating material comprises the features listed below.

The web of paper support is passed through the gap between two rubber rollers rotating in the same direction, the gap amounting to −200 μm to −10 μm, in particular −50 μm to −10 μm.

Thus, the top side of the web of paper support is treated with the first coating material by means of the first rubber roller. The first coating material is transferred beforehand to the first rubber roller by a first screen roller which rotates in the opposite direction and which in turn is supplied with the first coating material by means of a pouring device.

The bottom side of the web of paper support is treated in parallel with the second coating material by means of a second rubber roller, the second coating material being transferred to the second rubber roller by a second screen roller rotating in the opposite direction. The second screen roller is likewise supplied with the second coating material by means of a further pouring device.

The first screen roller and the second screen roller are driven, in particular, at a relative speed of 50% to 150%, preferably 90% to 135%, in the direction opposite to that of the first and second rubber rollers.

In an alternative process for the simultaneous treatment of the top and bottom sides of a web of paper support each with a liquid coating material, the web of paper support is passed through the gap between a rubber roller and a second screen roller rotating in the direction opposite to that of the rubber roller, the gap between the rubber roller and screen roller amounting to −200 μm to −10 μm, in particular −50 μm to −10 μm.

The top side of the web of paper support is treated with the first coating material via the rubber roller. The first coating material is transferred to the rubber roller by a first screen roller rotating in the opposite direction and which in turn receives the first coating material from a pouring device.

The bottom side of the web of paper support is treated with the second coating material via the second screen roller, to which the second coating material is likewise applied via a further pouring device.

The first screen roller and the second screen roller are driven, in particular, at a relative speed of 50% to 150%, preferably 90% to 135%, in the direction opposite to that of the rubber roller and the support web.

The rubber rollers used in the process have advantageously a Shore hardness of 40 to 90, in particular 40 to 60.

The screen rollers preferably have a pitch of 18–80, in particular 36–60.

All the rollers, both the rubber rollers and the screen rollers, are driven separately in a preferred further development of the process.

The screen rollers are provided with a closed pouring box, into which the coating media are fed at a pressure of from 0.05 bar to 0.5 bar, preferably from 0.1 bar to 0.3 bar. The pressure data here always correspond to the prevailing chamber pressure.

The process is particularly advantageous if the first coating material is an aqueous primer dispersion and the second coating material is formed by an aqueous release dispersion.

Likewise, an aqueous release dispersion can advantageously be applied on one side as the first coating material, if the second coating material is simultaneously formed by an aqueous second layer coating.

The process according to the invention is outstandingly suitable for the coating of webs of paper support for the manufacture of adhesive tape, in particular webs of crepe paper support. Surprisingly, it has been found that the known disadvantages of the conventional coating processes do not arise. In the process according to the invention, the coating materials are, owing to the roller gap, applied to the paper surface at a slight positive pressure. Because of the fact that a coating material is applied at positive pressure simultaneously to both sides of the paper surface, a break-through of the composition is reliably prevented.

The particular depth of penetration of the coating materials can be controlled by the ratio of the pressures (that is to say the preadjustment of the roller gap and the level of filling of the screen rollers) as a function of the pressure of the filling with coating medium. This ensures constant quantities applied, and it becomes feasible to operate with minimum quantities applied.

A further advantage of the disclosed process is that, in the case of aqueous coating materials on both sides, an excellent plane position of the paper is obtained, which can be controlled via the quantity of coating. The reason for this is that the paper is treated simultaneously from both sides with the coating materials and an identical drying speed in a downstream suspension-jet dryer is preset on the top side and bottom side of the web of paper support. Swelling phenomena in the fibres, the release of strains in the surfaces or the generation of new strains (for example shrinkage due to hardening of residual hemicellulose and other amorphous constituents) take place in the same direction on the top side and bottom side of the paper.

The improved plane position in turn positively affects the quality of the coating of adhesive compound.

Outstanding results are obtained especially if the top side of the web of paper support is treated with an aqueous primer dispersion and the bottom side is treated with an aqueous release dispersion. Because of the simultaneous coating at one application point on the top side and on the bottom side, simultaneous wetting (water) of the web of paper support from both sides and an incorporation of solids into the paper take place. Within the paper thickness, an interface between the coating dispersion and precoating dispersion forms without mixing. This precludes the described undesired breakthrough of the coating materials.

The position of this interface in the paper can be influenced under control by the process selected in the invention. In particular, the selection of the screen rollers, of the selected chamber pressure, of the transfer rollers, of the relative speed of the rollers and also other parameters determine this interface.

The coating thickness, that is to say the thickness of the layer into which the particular coating material is intended to penetrate, is defined by the particular coating material itself.

A further advantage of the process according to the invention is that curling of the edges of the coated web of paper support is avoided, which can not be suppressed in the case of one-sided wetting.

BRIEF DESCRIPTION OF THE DRAWINGS

The process according to Claim 1, of particularly advantageous design, is illustrated in FIG. 1, and the process according to Claim 2 is illustrated in FIG. 2.

According to FIG. 1, the web 1 of paper support is passed in a straight line to the gap 23 between two rubber rollers 21, 22 rotating in the same direction. The rubber rollers 21, 22 are mounted on a frame not shown in more detail, the gap width between the rubber rollers 21, 22 being preadjustable via an appropriate setting mechanism.

Figure 1:
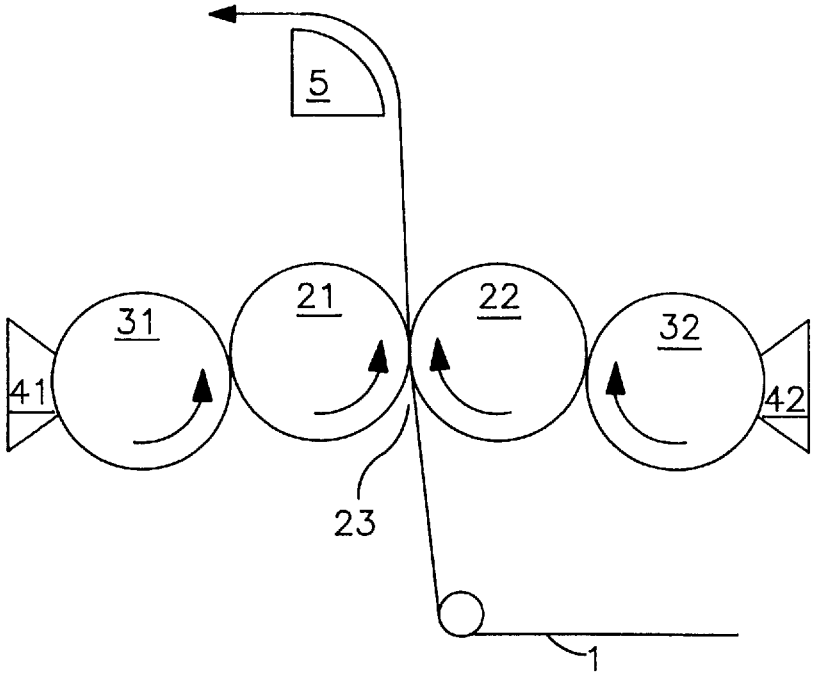

Via the first rubber roller 21, the bottom side of the web 1 of paper support is treated with an aqueous primer dispersion. The rubber roller 21 itself takes up the aqueous primer dispersion via a first screen roller 31 which is driven in the direction opposite to the rubber roller 21. A first pouring device 41, which advantageously is operated at a slight positive pressure of from 0.05 bar to 0.5 bar, coats the screen roller 31.

Via the second rubber roller 22, the top side of the web 1 of paper support is treated with an aqueous coating dispersion. The rubber roller 22 and the screen roller 32, driven in the direction opposite to that of the former, likewise obtain the coating material from a second pouring device 42 advantageously operated at a slight positive pressure of 0.05 bar to 0.5 bar.

After the operation of coating the web 1 of paper support in the roller gap 23, the web is fed to a suspension-jet dryer, not further described, via a web-guide element 5 operating without contact.

This is followed by the further processing of the web of paper support in the form of coating with known solvent-based adhesive systems by conventional application processes.

Figure 2:
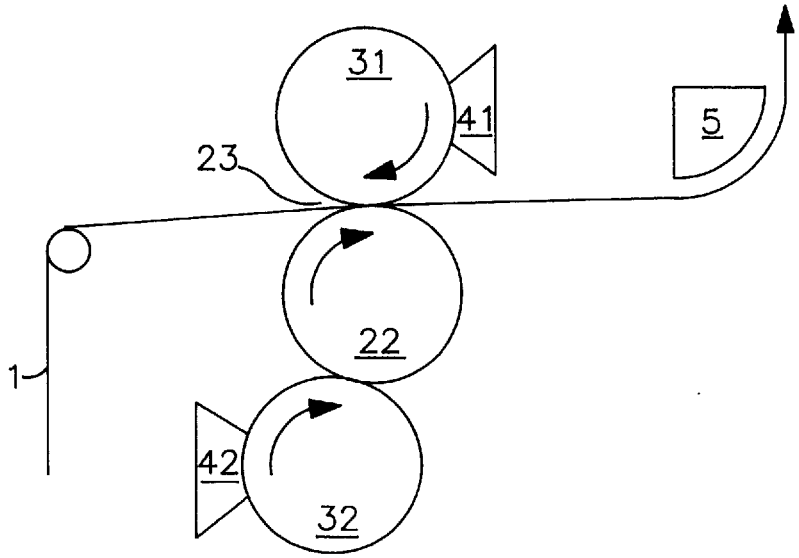

According to FIG. 2, the web 1 of paper support is passed into the roller gap 23 which is formed by a rubber roller 22, driven in the same direction as the web 1 of the paper support, and by a first screen roller 31 which is driven in the direction opposite to that of the web 1 of the paper support and of the rubber roller 22.

The screen roller 31 here directly coats the bottom side of the web 1 of paper support with an aqueous primer dispersion, the screen roller 31 being supplied with the coating material via a first pouring device 41.

In accordance with the process described above, the application of the aqueous coating dispersion likewise takes place via a rubber roller 22 which is supplied with the coating dispersion via a screen roller 32 which in turn receives the coating material from a second pouring device 42.

The process will be characterized in more detail below by reference to three examples which are not intended to be in any way limiting in their effect.

EXAMPLE 1

Thin web of paper support, namely a flat crepe support
Thickness of the web of paper support: 150 gm The web of paper support was impregnated in an upstream operation with an impregnation based on an SBR latex. The impregnation was carried out on a conventional impregnating unit which is supplied by various suppliers. In this case, an impregnating unit from VITS (Erkrath) was used. The impregnation was carried out by the dipping process, with subsequent squeezing-off of the excess in a squeezer. The impregnation feed was carried on until the paper was completely saturated.

The two-sided coating of the process according to the invention was carried out in the dual application unit, using the following liquid media:

First coating material: aqueous primer dispersion
Grafted natural rubber latex
Viscosity: Newtonian flow behaviour Ford flow cup with 4 mm nozzle: 16±1 second
Mass applied: 1.5 g/m$^2$ of dry mass
Second coating material: aqueous paint dispersion (release coating)
Mixture of synthetic rubber latex with release emulsions based on acrylate or copolymer of styrene and maleamide
Viscosity: Non-Newtonian flow behaviour, 600 mpa*s at 0.1 1/s 70 mpa*s at 100 1/s and 23° C.

Mass applied: 6 g/m$^2$ of dry mass

The unit according to the invention was a pilot plant unit for determination of the parameters cited in the description. The rollers were set up in the roller frame of a 5-roller applicator, and subsequent drying was carried out in a suspension-jet dryer.

On the primary dispersion side, the following process parameters indicated in the table were selected in this case:

| | |
|---|---|
| Chamber pressure in the pouring box | 0.2 bar |
| Screen roller | 60's pitch |
| Screen roller diameter | 200 mm |
| Speed relative to the rubber roller | 135% |
| Rubber roller | 55 Shore, PUR |
| Rubber roller diameter | 200 mm |
| Speed of the rubber roller | web speed up to 400 m/minute |

On the side of the coating dispersion, the following unit parameters were realized:

| | |
|---|---|
| Chamber pressure in the pouring box | 0.1 bar |
| Screen roller | 38's pitch |
| Screen roller diameter | 200 mm |
| Speed Relative to the rubber roller | 135% |
| Rubber roller | 55 Shore, PUR |
| Rubber roller diameter | 200 mm |
| Speed of the rubber roller | web speed up to 400 m/minute |

The gap between the rubber rollers was preset to −80 $\mu$m.

After the coating had been carried out appropriately, no breakthrough of mass was observed, and the dry masses applied were approximately 30% less than in conventional processes.

The support thus finished was coated with 50 g/m$^2$ (dry matter) of a solvent-based natural rubber adhesive compound. This is an adhesive compound which can later be crosslinked by EBC and is used as a standard for the crepe tapes, and it consists of natural rubber, adhesive resins and fillers.

Standard adhesion technology data (in particular the unrolling force) and application results were outstanding:

All measurements were carried out at 23° C. and 50% relative humidity.

| | | | Analogously to |
|---|---|---|---|
| Adhesive force on steel | 3.9 N/cm | Peeling speed 300 mm/min | AFERA 4001 |
| Adhesive force on rear | 1.8 N/cm | Peeling speed 300 mm/min | AFERA 4001 |
| Unrolling force | 1.0 N/cm | Unrolling speed 30 m/min | AFERA 4013 |
| Maximum tensile force | 42 N/cm | Test speed 300 mm/min | AFERA 4004 |
| Elongation at break | 10% | | AFERA 4005 |

The product produced by the process according to the invention was, according to the results of the application investigation, very suitable as a masking tape for painting. In particular, it proved to be outstandingly resistant to emulsion paints. In the strip-peeling test of specimen strips stuck to steel sheet and painted with commercially available emulsion paint, there was no splitting of the product in any case, neither after 5, 10, 15 nor after 20 minutes of action by the emulsion paint.

It was possible to remove the product again without tearing from various substrates, even after prolonged adhesive bonding time and under extreme peeling conditions (extremely rapid, extreme tension). Explicitly, glass and PVC with sticking times of up to 24 hours were tested.

EXAMPLE 2

Production of an adhesive tape based on transparent paper, greaseproof paper or highly densified glassine paper Here again, the primer dispersion and the release coating dispersion were coated from the aqueous phase.

The primer used was an aqueous solution of a commercially available polyvinyl alcohol (tradename Mowiol from Hoechst). The viscosity was adjusted to 18±4 seconds from a Ford flow cup with a 4 mm nozzle.

In further experiments, primers based on cellulose esters or cellulose ethers, alginates or galactomannans were also used.

The release component consisted of the mixture of a polyvinyl alcohol solution (see above) with a silicone release emulsion. The polyvinyl alcohol here carries out the function of the film former, and the quantity of silicone emulsion can be matched to the particular desired separating effect. The viscosity of the release dispersion was adjusted to 18±4 seconds in a Ford cup with a 4 mm outlet nozzle.

The supports coated in this way were immediately afterwards coated with a solvent-based acrylate adhesive compound. This is a 38% solvent-based acrylate adhesive compound which can be obtained, for example, from National Starch. 20±2 g/m$^2$ of adhesive compound were applied.

The coating unit used for this purpose was a channel coating unit with a knife-over-roller applicator.

The unit according to the invention was a pilot plant unit for determining the parameters cited in the description. In this case, the rollers were built up in the roller frame of a 5-roller applicator, and the subsequent drying was carried out in a suspension-jet dryer.

On the side of the primer dispersion, the following process parameters indicated in the table were selected:

| | |
|---|---|
| Chamber pressure in the pouring box | 0.15 bar |
| Screen roller | 60's pitch |
| Screen roller diameter | 200 mm |
| Speed relative to the rubber roller | 135% |
| Rubber roller | 55 Shore, PUR |
| Rubber roller diameter | 200 mm |
| Speed of the rubber roller | web speed up to 400 m/minute |

On the side of the paint dispersion, the following unit parameters were realized:

| | |
|---|---|
| Chamber pressure in the pouring box | 0.2 bar |
| Screen roller | 60's pitch |
| Screen roller diameter | 200 mm |
| Speed relative to the rubber roller | 135% |
| Rubber roller | 55 Shore, PUR |
| Rubber roller diameter | 200 mm |
| Speed of the rubber roller | web speed up to 400 m/minute |

The gap between the rubber rollers was set beforehand to −20 $\mu$m.

EXAMPLE 3

Production of an adhesive tape based on the supports mentioned in Example 2 with an acrylate dispersion adhesive compound In a further experiment, commercially available acrylate dispersion (tradename PS 83D from Rohm and Haas) was used as the adhesive compound. The dispersion was here applied in place of the primer via the primer delivery unit. With use of the acrylate dispersion, using the primer was unnecessary. The adhesive tape thus obtained was recyclable.

The acrylate dispersion adhesive was used at a viscosity of 200–600 mpa*s at 30 1/s and 20° C. The mass applied was adjusted to 20±1 g/m$^2$.

The release coating was adjusted to a viscosity of 18±4 seconds in a Ford flow cup with a 4 mm nozzle.

The unit according to the invention was a pilot plant unit for determining the parameters cited in the description. In this case, the rollers were built up in the roller frame of a 5-roller applicator, and the subsequent drying was carried out in a suspension-jet dryer.

In this case, the transferring primer rubber roller was dismantled and the primer screen roller was brought into direct contact with the paper support in the direction opposite thereto (example unit 2).

In this case, the following process parameters indicated in the table were selected on the adhesive dispersion side:

| | |
|---|---|
| Chamber pressure in the pouring box | 0.2 bar |
| Screen roller | 20's pitch |
| Screen roller diameter | 200 mm |
| Speed relative to the | 135% |

-continued

| | |
|---|---|
| rubber roller | |
| Rubber roller | 55 Shore, PUR |
| Rubber roller diameter | 200 mm |
| Speed of the rubber roller | 75% of the web speed up to 400 m/minute |

On the side of the release dispersion, the following unit parameters were realized:

| | |
|---|---|
| Chamber pressure in the pouring box | 0.2 bar |
| Screen roller | 60's pitch |
| Screen roller diameter | 200 mm |
| Speed relative to the rubber roller | 135% |
| Rubber roller | 55 Shore, PUR |
| Rubber roller diameter | 200 mm |
| Speed of the rubber roller | web speed up to 200 m/minute |

The gap between the screen roller for the adhesive dispersion and the release rubber roller was adjusted beforehand to −50 μm.

We claim:

1. Process for the simultaneous treatment of the top and bottom sides of a web of paper support each with a liquid coating material, which comprises a) passing said web of paper support through the gap between two rubber rollers rotating in the same direction, b) treating the top side of said web of paper support with a first coating material by means of a first rubber roller, transferring said first coating material to said first rubber roller by a first screen roller rotating in the opposite direction, applying said first coating material to said first screen roller by means of a pouring device, treating the bottom side of said web of paper support with a second coating material by means of a second rubber roller, transferring said second coating material to said second rubber roller by a second screen roller rotating in the opposite direction, applying said second coating material to said second screen roller by means of a pouring device.

2. Process for the simultaneous treatment of the top and bottom sides of a web of paper support each with a liquid coating material, which comprises a) passing said paper support through the gap between a rubber roller and a second screen roller rotating in the direction opposite to that of the rubber roller, b) treating the top side of said web of paper support with a first coating material by means of said rubber roller, transferring said first coating material to the rubber roller by a first screen roller rotating in the opposite direction, applying said first coating material to said first screen roller by means of a pouring device, c) treating the bottom side of said web of paper support with a second coating material by means of said second screen roller, and applying said second coating material to said second screen roller by means of a pouring device.

3. Process according to claim 2, wherein the first screen roller and the second screen roller are driven at a relative speed of 50% to 150%, preferably 90% to 135%, in the direction opposite to that of the rubber roller and the web of paper support.

4. Process according to claim 1, wherein the rubber rollers have a Shore hardness from 40 to 90, in particular 40 to 60.

5. Process according to claim 1, wherein the screen rollers have a pitch of 18–80, in particular 36–60.

6. Process according to claim 1, wherein the rubber rollers and the screen rollers are each driven separately.

7. Process according to claim 1, wherein the screen rollers are each provided with a closed pouring box, into which the coating media are fed at a pressure of from 0.05 bar to 0.5 bar, preferably from 0.1 bar to 0.3 bar.

8. Process according to claim 1, wherein the first coating material is an aqueous primer dispersion or water and the second coating material is formed by an aqueous release dispersion.

9. Process according to claim 1, wherein the first coating material is an aqueous release dispersion and the second coating material is formed by an aqueous aftercoating dispersion.

10. Process according to claim 1, wherein the first screen roller and the second screen roller are driven at a relative speed of 50% to 150%, preferably 90% to 135%, in the direction opposite to that of the first rubber roller and second rubber roller.

11. Process according to claim 1, wherein the gap between the two rubber rollers and between the rubber roller and screen roller is −200 μm to −10 μm, in particular −50 μm to −10 μm.

* * * * *